US005846167A

United States Patent [19]

Liu et al.

[11] Patent Number: 5,846,167

[45] Date of Patent: Dec. 8, 1998

[54] SWIMMING EXERCISE METHOD AND TETHER THEREFOR

[75] Inventors: Yiu Ching Liu, Lake Oswego; Samuel O. Engels, West Linn, both of Oreg.

[73] Assignee: Pacific Cornetta, Inc., Tualatin, Oreg.

[21] Appl. No.: 998,697

[22] Filed: Dec. 29, 1997

[51] Int. Cl.[6] ..... A63B 31/00

[52] U.S. Cl. ..... 482/55; 482/111

[58] Field of Search ..... 482/55, 54, 111

[56] References Cited

U.S. PATENT DOCUMENTS

| | | | |
|---|---|---|---|
| 3,445,941 | 5/1969 | Eaves et al. | 482/55 |
| 3,988,020 | 10/1976 | Carter | 482/55 |
| 4,247,096 | 1/1981 | Schmitt | 482/55 |
| 4,524,711 | 6/1985 | Ashrow | 482/55 |
| 4,544,155 | 10/1985 | Wallenbrock et al. | 482/55 |
| 4,552,540 | 11/1985 | Bass | 482/55 |
| 4,577,859 | 3/1986 | Gossett | 482/55 |
| 5,020,791 | 6/1991 | Phillips | 482/55 |
| 5,236,404 | 8/1993 | MacLennon | 482/55 |
| 5,391,080 | 2/1995 | Bernacki et al. | 482/55 |

*Primary Examiner*—Lynne A. Reichard
*Attorney, Agent, or Firm*—Olson and Olson

[57] ABSTRACT

A swimming exercising and training tether device includes an elongated tether line connected at one end preferably through a coil spring or other elastic, shock-absorbing member, to an anchor adjacent a wall of a swimming pool and at the opposite end detachably to the back panel of a harness worn by a swimmer. The attachment to the back panel is in the area intermediate the shoulders of the swimmer. Intermediate the ends of the tether line it extends freely through a loop or ring secured to the back panel of the harness in the area intermediate the hips of the swimmer. The loop or ring functions to raise the hips of the swimmer to the level promoting most efficient swimming posture in the water.

6 Claims, 1 Drawing Sheet

W
12
20
28
30
24
22
38
18'
40
32
18
S
17
16'
16
10
14
26
36
34
38
18'
18
16'
17

SWIMMING EXERCISE METHOD AND TETHER THEREFOR

BACKGROUND OF THE INVENTION

This invention relates to swimming exercising and training, and more particularly to a tether device and method by which such exercising and training may be accomplished in a confined pool of water.

Various types and forms of tether devices have been proposed heretofore for enabling swimming in confined spaces. Typical of these are the tethers disclosed in U.S. Pat. Nos. 4,530,497; 4,527,795; and 4,247,096. All of these are characterized by the attachment of one end of a tether to a location on a swimmer that inhibits positioning of the swimmer's body in proper orientation in the water for efficient swimming.

SUMMARY OF THE INVENTION

The swimming tether device and method of this invention involves a harness component configured to be worn by a swimmer and provided with a tether anchor on the backside of the harness adjacent the shoulders of the swimmer and a tether guide ring on the backside of the harness adjacent the hips of the swimmer through which the elongated tether component extends to a tether anchor adjacent the confined body of water in which a swimmer may train or exercise.

It is the principal objective of this invention to provide a swimming tether and method by which a swimmer may exercise and train in a confined pool of water while maintaining proper posture for most efficient swimming.

Another objective of this invention is to provide a swimming tether of the class described in which the harness is in the form of a swimsuit having neck and arm openings.

A further objective of this invention is the provision of a swimming tether of the class described in which the tether may be of any length desired to accommodate swimming pools and other bodies of water of any dimension.

The foregoing and other objects and advantages of this invention will appear from the following detailed description taken in connection with the accompanying drawings of a preferred embodiment.

DESCRIPTION OF THE PREFERRED EMBODIMENT

Figures 1, 2, 3, 4:
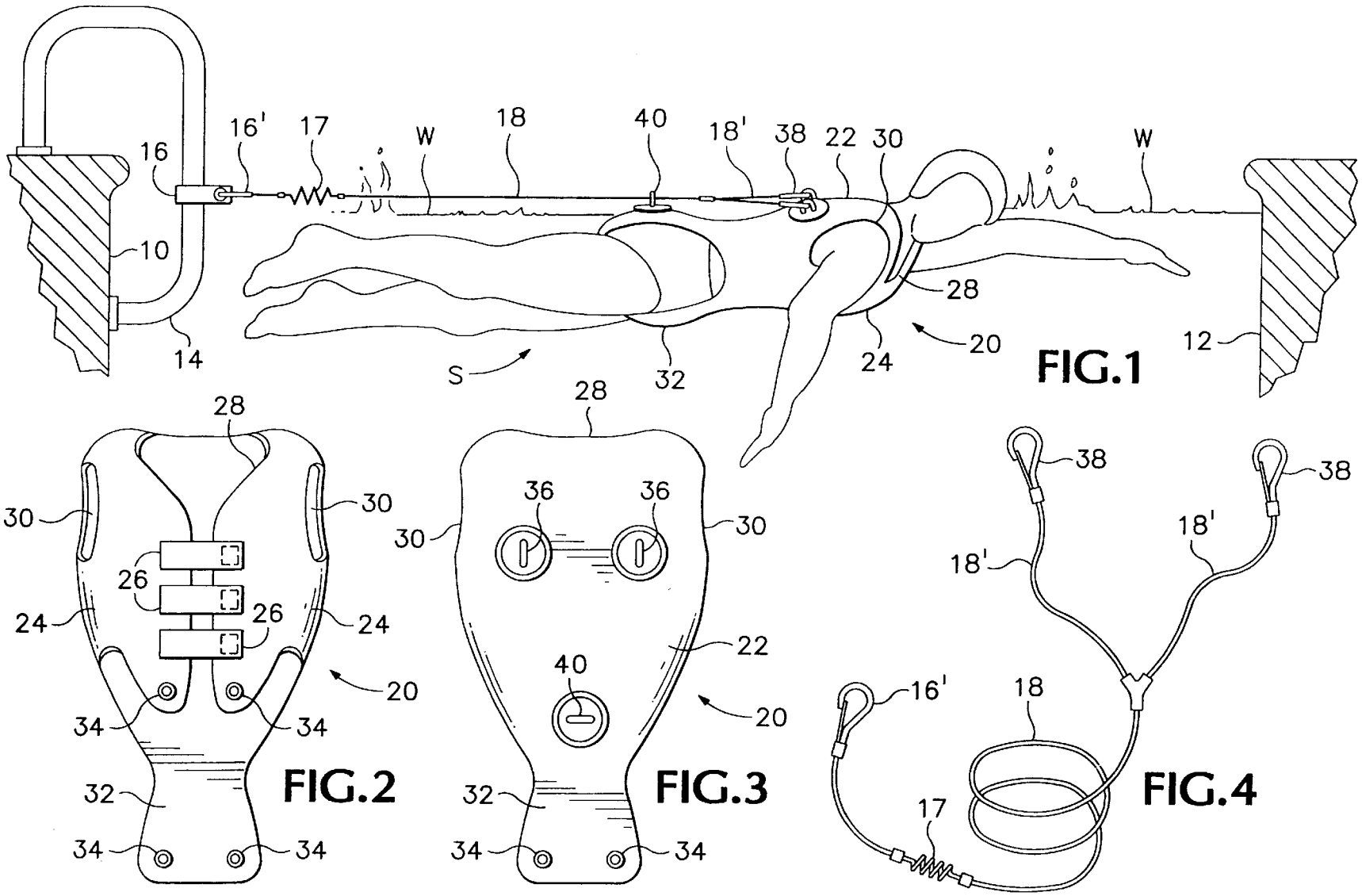
FIG. 1 is a perspective view of a person swimming in a small swimming pool and employing a swimming tether device embodying the features of this invention.
FIG. 2 is a perspective view of the front side of a harness component of the swimming tether device of this invention.
FIG. 3 is a perspective view of the backside of the harness component of FIG. 2.
FIG. 4 is a perspective view of an elongated tether component of the swimming tether device of this invention.

FIG. 1 of the drawings shows a swimmer S disposed in a small swimming pool of water W in ideal posture for efficient swimming. The body of water is shown to be restricted in length between the walls 10 and 12 of the swimming pool.

An anchor 14 at wall 10 serves to secure a strap connector 16 with hook 16' to one end of an elongated, shock-absorbing coil spring 17. The opposite end of the spring is coupled to one end of an elongated flexible tether line 18.

The opposite end of the tether line is connected to a harness 20 worn by the swimmer.

In the embodiment illustrated, the harness is configured as a swimsuit having a back panel 22 joined to front panels 24 which are secured together by such connector means as straps 26. Between the back and front panels are formed a neck opening 28 and arm openings 30. Extending from the lower end of the back panel is an elongated crotch strap 32 configured to extend forwardly through the crotch of a swimmer for detachable connection to the front panels 24 by such means as snap fastener or Velcro pairs 34.

A pair of coupler loops 36 are secured to the back panel 22. They are spaced apart laterally in a transverse plane in the areas of the shoulders, preferably adjacent the bottom ends of the arm openings 30. The loops 36 are arranged for releasable connection of hook members 38 on the ends of the bifurcated sections 18' of the tether line 18 opposite the connector 16.

An important feature of this invention is the hip loop or ring 40 secured to the back panel 22 adjacent the juncture with the crotch strap 32. The tether line 18 extends freely through the hip ring and functions upon tensioning of the tether line to raise the hips of a swimmer to the position required for efficient swimming posture. In the absence of hip ring 40, the hips of a swimmer sag into the water to a depth which inhibits efficient swimming.

It will be appreciated that by use of the tether device of this invention, swimming exercising and training may be conducted in any body of water that needs only to be slightly longer than the swimmer. Thus, the tether device may be anchored to one side or end wall of a swimming pool; it may be anchored to a post in a lake or river; and it may be anchored to a side wall of a spa.

It also will be appreciated that the harness 20 may take many forms. For example, the swimsuit may terminate at the waist and provide only the base for the connector loops 36. The hip ring 40 may be provided by swim trunks or by a waste belt.

Although the connection of the tether line 18 to the back panel 22 of the harness preferably is made by the hook members 38 on the bifurcated section 18' of the tether line, a single connector may be employed by centering a single connector loop 36 on the back panel intermediate the arm openings 30 and by terminating the tether line in a single loop member 38.

The coil spring 17 and tether line 18 may be provided in any length desired, commensurate with the length of the body of water W in which it is to be used. Indeed, the tether line may be provided as a length of rubber or other elastic material, thereby eliminating spring 17.

The foregoing and other modifications and changes in the size, shape, type, number and arrangement of components of the tether device may be made, as desired, without departing from the spirit of this invention and the scope of the appended claims.

We claim:

1. A method of tethering a swimmer for swimming in a confined body of water, comprising:

a) securing one end of a tether line to a fixed support adjacent a swimming area of a body of water, b) securing the opposite end of the tether line to the back of a swimmer in the area between the shoulders, and c) extending an intermediate portion of the tether line freely through a ring secured to the back of the swimmer in the area between the hips.

2. The method of claim 1 including providing a harness for wearing by a swimmer, and securing the said opposite end of the tether line to the harness in the area between the shoulders, and securing the said ring to the harness in the area between the hips.

3. A swimming exercising and training tether device, comprising:

a) an elongated flexible tether line, b) first connector means on one end of the tether line for securing said end to an anchor adjacent a body of water, c) second connector means on the opposite end of the tether line, d) second connector coupler means configured for support on a swimmer in the area of the back between the shoulders and arranged for coupling the second connector means thereto, and e) tether line guide ring means configured for support on a swimmer in the area of the back between the hips for slidably receiving the tether line intermediate the first and second connector means.

4. The tether device of claim 3 including a harness adapted for wearing by a swimmer and having a back panel, the second connector coupler means being secured to the back panel in the area between the shoulders of a swimmer, and the guide ring means being secured to the back panel in the area between the hips of a swimmer.

5. The tether device of claim 4 wherein the harness includes front and back panels and a crotch strap extending from the back panel for releasable connection to the front panel.

6. The tether device of claim 5 wherein the front panel includes a pair of lateral panels having interengaging connector means for releasably securing said front panels together at the front of a swimmer.

* * * * *